US009694878B2

(12) United States Patent
Johnston

(10) Patent No.: US 9,694,878 B2
(45) Date of Patent: Jul. 4, 2017

(54) MOORING DEVICE

(71) Applicant: Miller O. Johnston, North Little Rock, AR (US)

(72) Inventor: Miller O. Johnston, North Little Rock, AR (US)

( * ) Notice: Subject to any disclaimer, the term of this patent is extended or adjusted under 35 U.S.C. 154(b) by 0 days.

(21) Appl. No.: 15/366,990

(22) Filed: Dec. 1, 2016

(65) Prior Publication Data

US 2017/0080995 A1 Mar. 23, 2017

Related U.S. Application Data

(63) Continuation-in-part of application No. 14/779,709, filed as application No. PCT/US2014/031575 on Mar. 24, 2014.

(60) Provisional application No. 61/806,372, filed on Mar. 28, 2013.

(51) Int. Cl.
*B63B 21/00* (2006.01)
*B63B 21/20* (2006.01)

(52) U.S. Cl.
CPC ..... *B63B 21/20* (2013.01); *B63B 2021/203* (2013.01); *B63B 2209/18* (2013.01)

(58) Field of Classification Search
CPC ..... B63B 21/20
See application file for complete search history.

(56) References Cited

U.S. PATENT DOCUMENTS

| | | | | |
|---|---|---|---|---|
| 5,931,112 | A * | 8/1999 | Lacan | B63B 21/08 114/218 |
| 7,418,913 | B2 * | 9/2008 | Dowd | B63B 21/00 114/219 |
| 2006/0150883 | A1 * | 7/2006 | Gordon | B63B 21/04 114/230.23 |
| 2011/0146557 | A1 * | 6/2011 | Underwood | B63B 21/04 114/230.23 |

* cited by examiner

*Primary Examiner* — Stephen Avila
(74) *Attorney, Agent, or Firm* — Charles McCloskey

(57) ABSTRACT

A mooring device includes a canister, a spool having two side walls with teeth around their perimeters, a mooring cable wrapped around the spool, a lid having a first piece and a second piece, and two pairs of stops extending from the bottom surface of the lid. The two pairs of stops engage the notches of the two side walls of the spool when the first piece of the lid rests in the closed position. The stops disengage from the notches when the first piece of the lid is open. A thumbpad allows a user to move the stops from a lock position to an unlocked position without opening the lid. The device extends and retracts the cable to accommodate tidal and other water action.

20 Claims, 19 Drawing Sheets

MOORING DEVICE

CROSS-REFERENCE TO RELATED APPLICATION

This non-provisional application claims priority to pending non-provisional application Ser. No. 14/779,709 filed on Sep. 24, 2015 which claims priority to expired Patent Cooperation Treaty application No. PCT/US2014/031575 filed on 24 Mar. 2014 which claims priority to expired provisional application No. 61/806,372 filed on 28 Mar. 2013, all of which are owned by the same inventor.

BACKGROUND OF THE INVENTION

The present invention relates generally to a mooring device and, more specifically, to a mooring device attachable to a dock or a pier.

Long, long ago, early man crossed water on a log. The log came from near early man's path and was left on the other side of the water. Man then developed technology over the eons taking the humble log as a vessel and making canoes, oar powered ships, junks, sail powered ships, and the like. In recent centuries, people developed various propulsion systems for vessels. Then steamers, diesel ships, electric ships, nuclear powered ships, both on the water and below it entered the service of commerce and pleasure. However propelled, a ship eventually needs refueling, maintenance, to meet a schedule, or faces bad weather and the ship heads to a port. At the port, the ship then finds a berth or a slip near a dock. Presently, ships then tie to the dock and the crew then completes various tasks when dockside in preparation for the next voyage.

Ships come in various sizes from the enormous—aircraft carriers- to the smallest—john boats. Larger vessels require assistance from tugboats during docking and then large lines from the vessel to the tiedowns on the dock. Docks for large vessels have significant structure to themselves. Ships of smaller size serve the needs of commerce and pleasure. Similar to enormous ships, luxury yachts have their own lines that secure to exclusive docks. Pleasure craft then have various sizes and operate in both freshwater and saltwater. Pleasure craft can be owned by various members of the public with various levels of means. Owners of pleasure craft then dock them on waterways and bodies of water across the country. Pleasure craft tie up at docks in between voyages or when an owner has return to a land based occupation, often at a distance from the location of the pleasure craft.

DESCRIPTION OF THE PRIOR ART

Historically, mooring or docking a boat has involved tying mooring cables, such as ropes, around elongated cleats that are attached to the ends of a dock, pier, or slip. This prior art mooring process and equipment have several drawbacks. First, because the cleats are elevated from the dock, pier, or slip, the cleats pose a tripping hazard to those walking or working on the dock, pier, or slip. Second, the excess cable that extends from the knots tied to the cleats poses a tripping hazard and gives a cluttered appearance on the dock, pier, or slip. Third, since most boats do not have dedicated storage for mooring cables, the cables rest on the seats or on the floor of the boat when the boat is not docked. This also gives a cluttered appearance and can pose a tripping hazard. It, therefore, would be desirable to develop a mooring device that overcomes these drawbacks.

A pleasure craft, or boat, tied up at dockside remains floating. The boat moves with the water surface. The water may move under tidal action, weather such as approaching storms, wakes on manmade inland lakes, dam adjustments of pool level, and other alterations to a water surface. For slight water surface changes, lines and cables keep a boat tied to the dock without failing. For larger water surface changes, lines and cables strain and may fail. A device that allows for extension and retraction of lines and cables would accommodate water surface changes and meet a need for the boating public.

SUMMARY OF THE INVENTION

The present invention is directed to a mooring device including a canister, a spool having two side walls with teeth around their perimeter, a mooring cable wrapped around the spool, a lid having a first piece and a second piece, and two pairs of stops extending from the bottom surface of the lid. The two pairs of stops engage the notches of the two side walls of the spool when the first piece of the lid rests in the closed position. The stops disengage from the notches when the first piece of the lid reaches the open position.

There has thus been outlined, rather broadly, the more important features of the invention in order that the detailed description thereof that follows may be better understood and that the present contribution to the art may be better appreciated. The invention may also have a size for installation in a boat gunwale. The invention may also have an application in a recessed chamber in an airport apron thus securing parked aircraft. Installation in a recessed chamber occurs to avoid snowplows and other equipment that keeps runways clear. Additional features of the invention will be described hereinafter and which will form the subject matter of the claims attached.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the present invention is to provide a mooring device that readily retracts a mooring line within it.

Another object is to provide such a mooring device that has a smooth top surface.

Another object is to provide such a mooring device that blends flush with adjacent decking.

Another object is to provide such a mooring device that retracts and releases its mooring line in coordination with the tide and weather.

Another object is to provide such a mooring device that temporarily fixes its spool against rotation for changing or repairing a mooring line.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In referring to the drawings.

The same reference numerals refer to the same parts throughout the various figures.

DESCRIPTION OF THE PREFERRED EMBODIMENT

The present invention overcomes the prior art limitations by providing a mooring device for improving the appearance and operation of a container of lines, ropes, and cables upon a dock, a boat, and the like.

Figure 1:
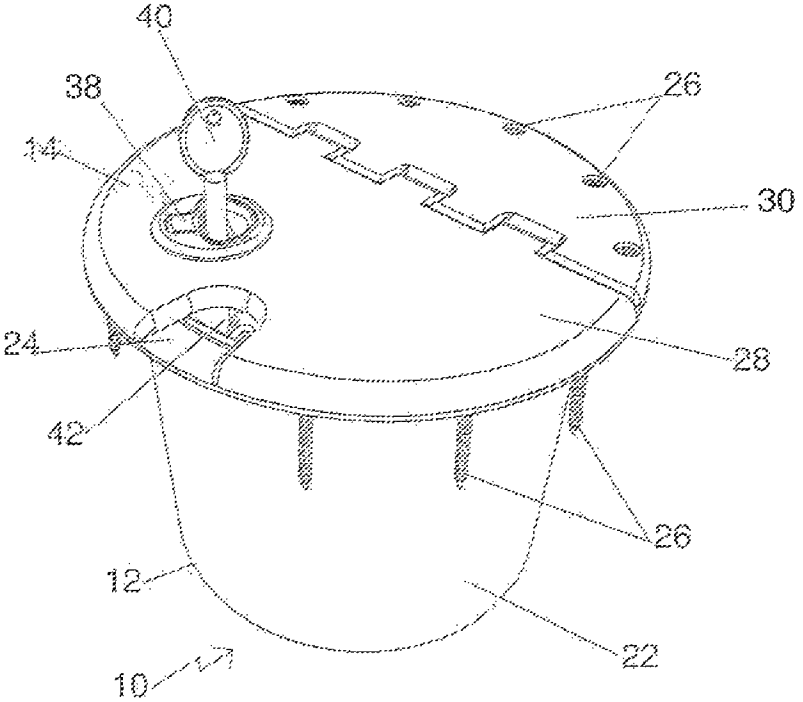
FIG. 1 is a top perspective view of the mooring device of the present invention.
Figure 2:
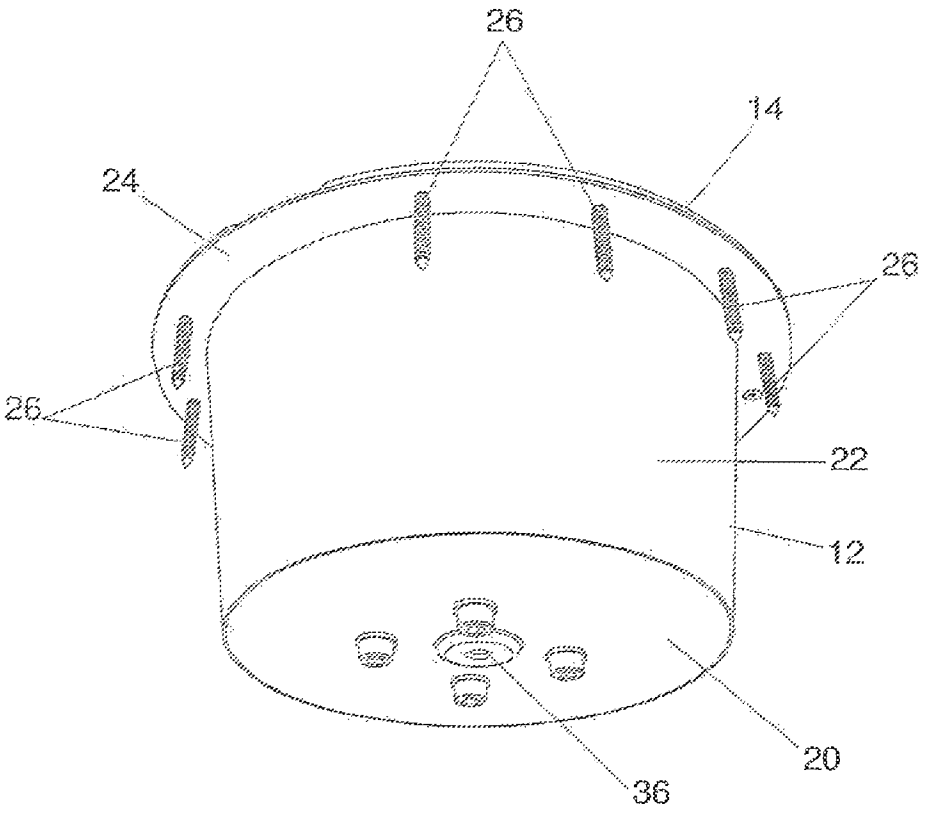
FIG. 2 is a bottom perspective view of the present invention.

With reference to FIGS. 1-16, the preferred embodiments of the present invention are hereby described. The mooring device 10 includes a cylindrical canister 12, a lid 14, and a spool 16 with a mooring cable 8 (e.g. rope) wrapped around it. As shown in FIGS. 1, 2, the canister 12 preferably has a flat bottom piece 20, a circular side wall 22 that extends vertically from the bottom piece, and a flange 24 around the opening at the top of the canister 12. The flange 24 rests on the top surface of a pier, dock, or slip 34 when the mooring device 10 is installed.

Figure 6:
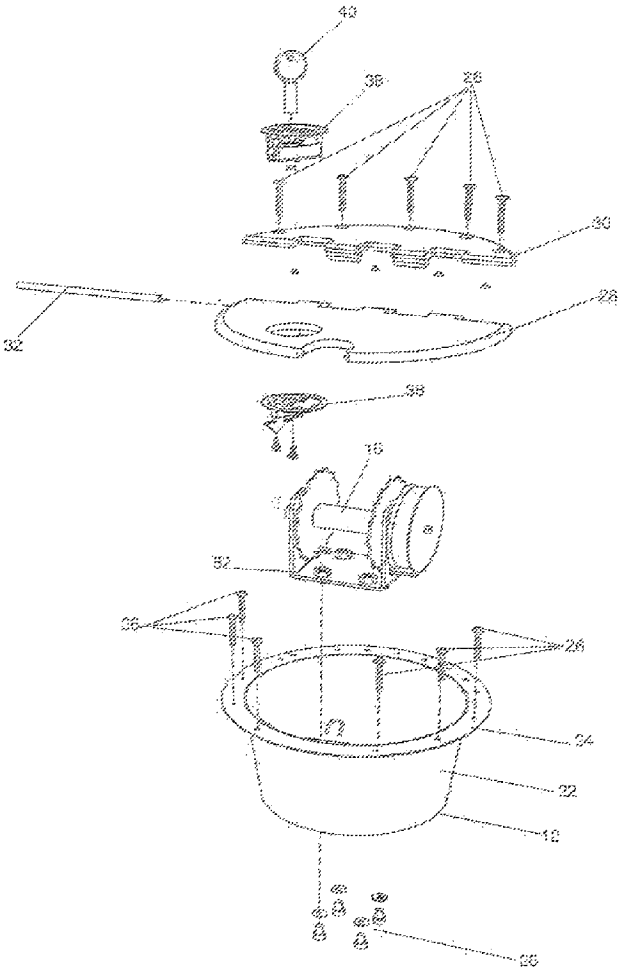
FIG. 6 is an exploded view of the present invention.
Figure 7:
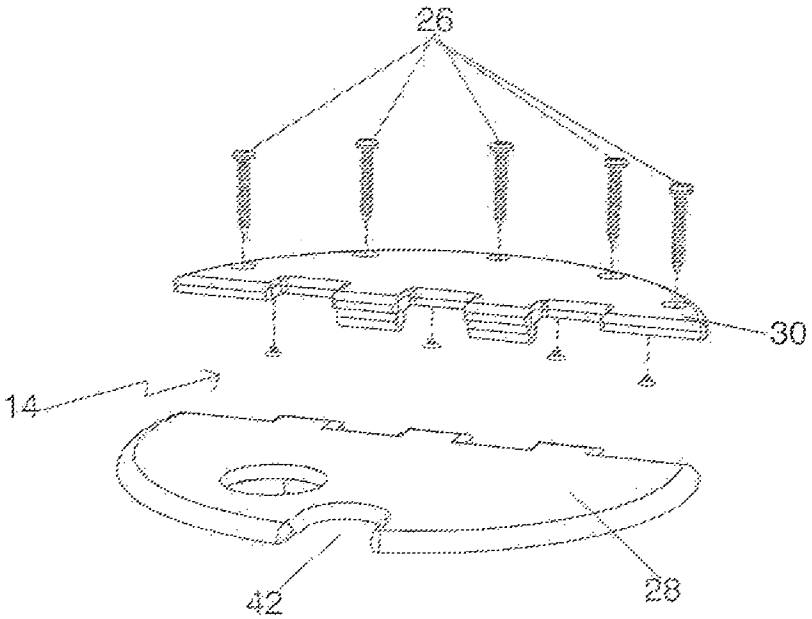
FIG. 7 is an exploded view of the present invention.

As shown in FIGS. 1, 3, 7, 14, the lid 14 includes two pieces hinged together. The second piece 30 of the lid 14 is fixed in place while the first piece 28 opens and closes. Both pieces of the lid 14 are preferably semicircular shaped. Thus, each piece has a curved edge joined to a straight edge, the two pieces 28, 30 are connected to one another at their straight edges via complementary notches. As shown in FIG. 6, a rod 32 is tethered 5 through the complementary notches, which hinges the two pieces 28, 30 together. A series of fasteners 26, such as tamper-proof screws, are positioned around the curved edge of the second piece of the lid 14. These fasteners 26 extend through the second piece 30 of the lid 14 and connect the second piece 30 of the lid to the flange 24 of the canister 12. The fasteners 26 also extend through the flange 24.

Figure 3:
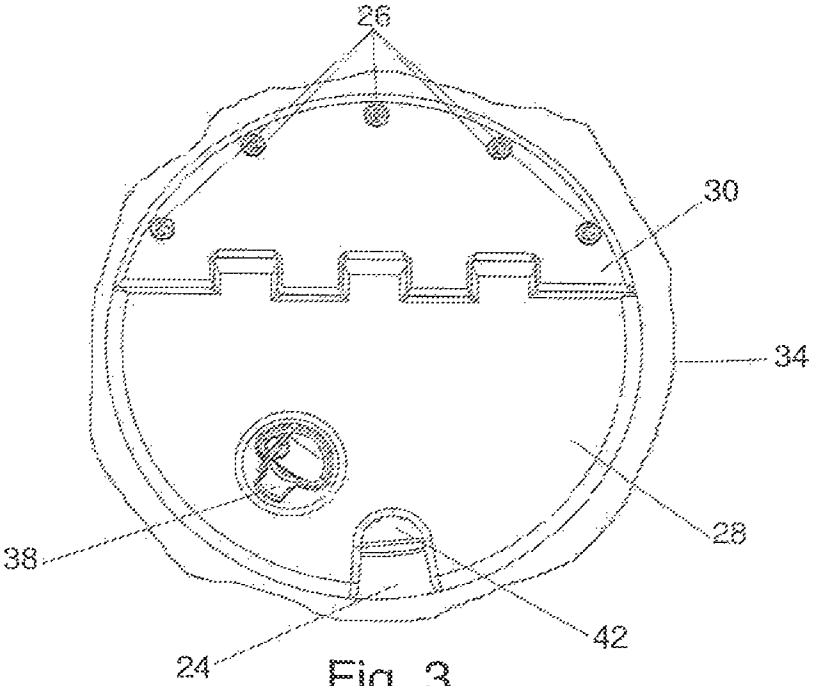
FIG. 3 is a top plan view of the lid of the present invention.
Figure 4:
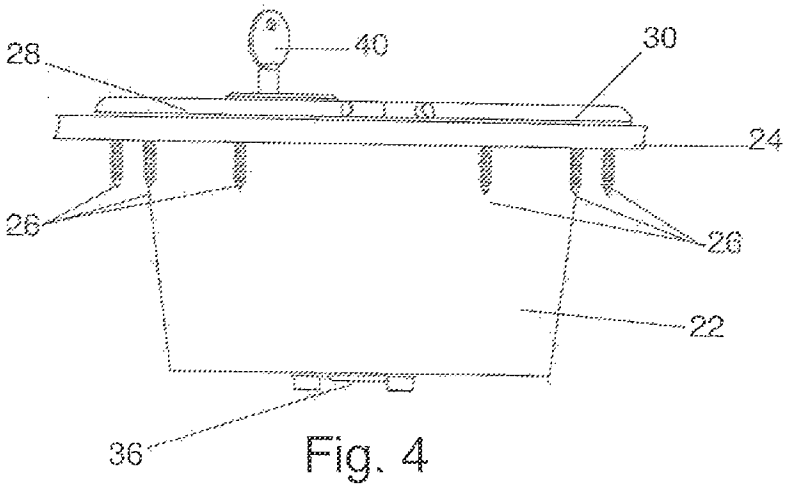
FIG. 4 is a side view of the mooring device of the present invention.
Figure 5:
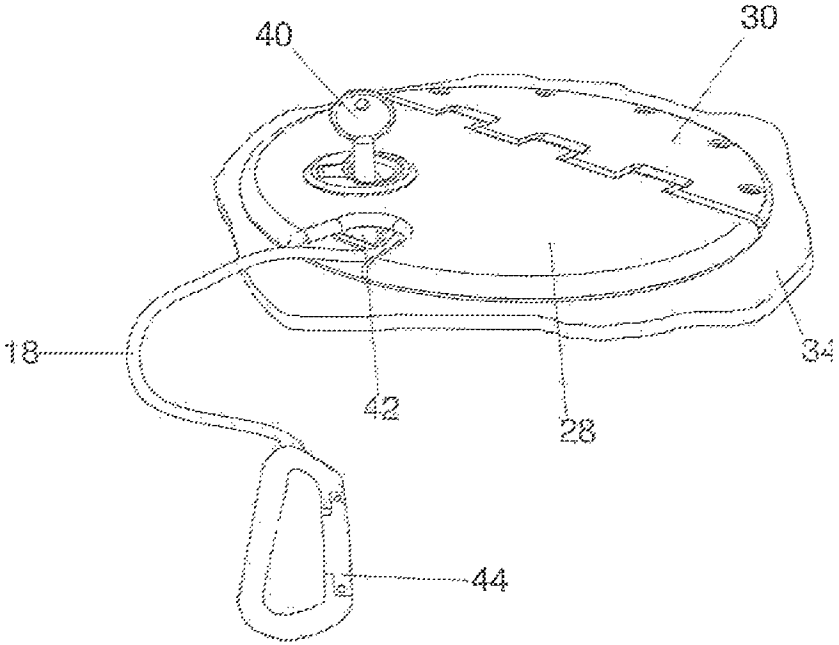
FIG. 5 is a top perspective view of the lid of the present invention installed in the surface of a dock.
Figure 13:
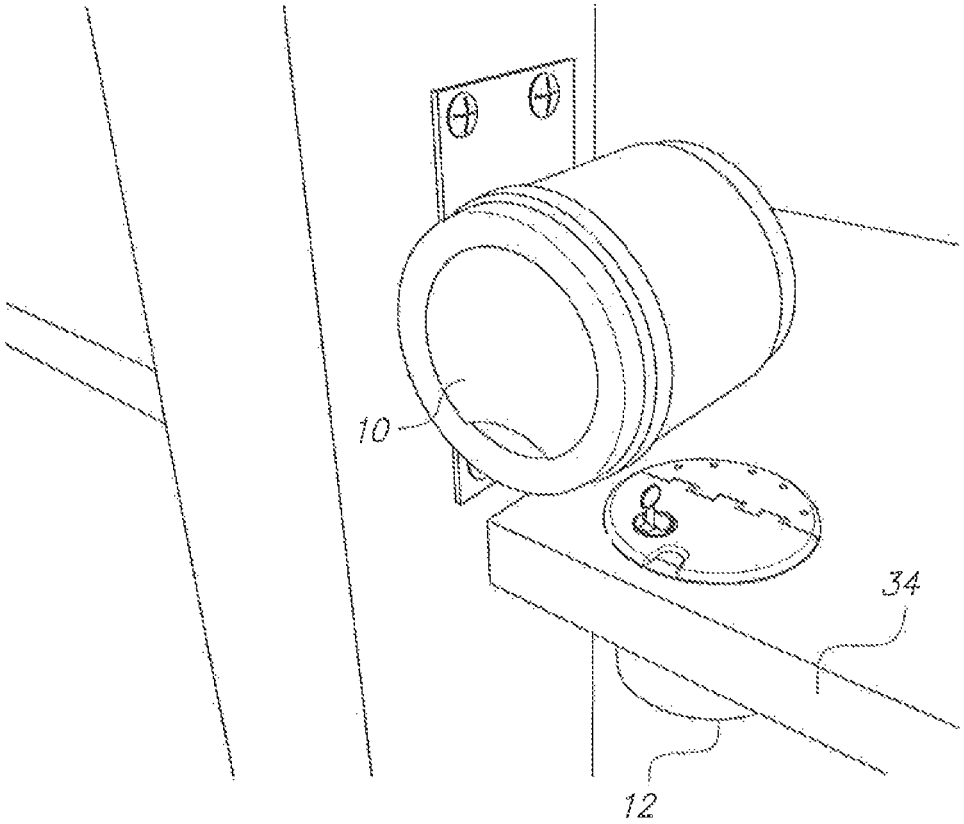
FIG. 13 is a perspective view of two embodiments of the present invention attached to a dock.

As shown in FIGS. 3, 5, 13, the canister 12 is preferably attached to a dock, pier, or slip 34 such that the lid 14 is substantially flush with the top surface of the dock, pier, or slip 34, The flange 24 and the lid 14 are the only portions of the mooring device 10 that extend above the top surface of the dock, pier, or slip 34. The fasteners 26 that extend through the second piece 30 of the lid 14 and the flange 24 fix the mooring device 10 to the dock, pier, or slip 34. While the fasteners do not extend through the first piece 28 of the lid 14, the fasteners 26 do extend through the flange 24 under the first piece 28 of the lid and into the dock, pier, or slip 34 to further secure the mooring device 10 to the dock, pier, or slip 34. Thus, as shown in FIG. 13, the canister 12 is positioned below the surface of the dock, pier, or slip 34. The bottom piece of the canister 12 preferably includes a drain hole 36 for releasing any water that accumulates in the canister 12, which prevents corrosion and other damage to the internal components of the mooring device.

Figure 14:
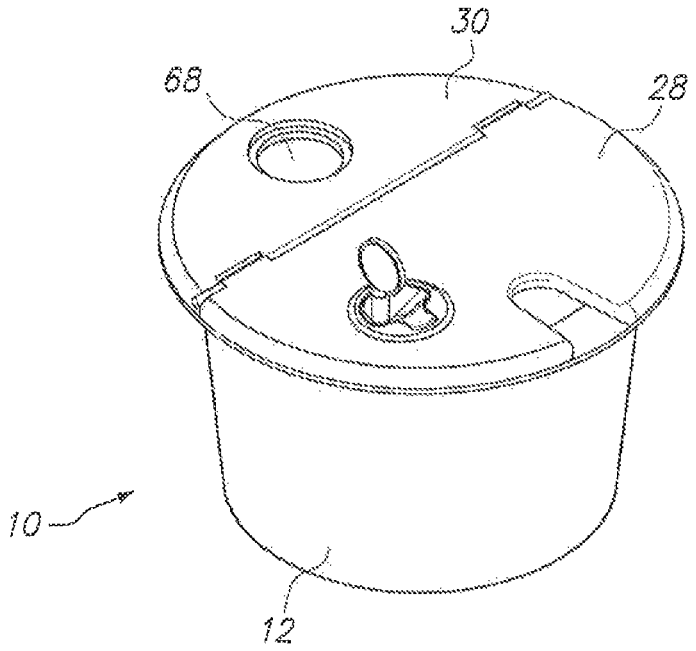
FIG. 14 is a perspective view of an alternative embodiment of the lid of the present invention.

As shown in FIG. 1, the first piece 28 of the lid 14 can be locked using a lock assembly 38 and a key 40. The lock assembly 38 is a two-piece assembly. The lock assembly 38 extends through an opening in the first piece 28 of the lid 14. The lock assembly 38 prevents tampering with the components of the mooring device 10 when it is not in use. The first piece 28 of the lid 14 also includes an opening 42 for the mooring cable 18 to be pulled from the canister 12. The end of the mooring cable 18 includes a carabiner 44. The carabiner 44 serves as an efficient and more secure way to attached the mooring cable 18 to the boat as compared to the prior art method of tying knots. The second piece 30 of the lid 14 preferably includes a solar-powered LED light 68 as shown in FIG. 14 to aid in finding the mooring device 10 in the dark and to reduce the risk of tripping on the dock.

Figure 8:
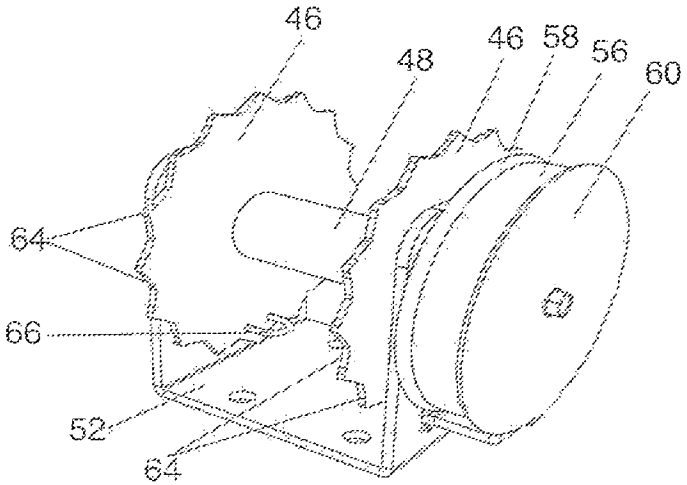
FIG. 8 is a perspective view of the present invention.
Figure 9:
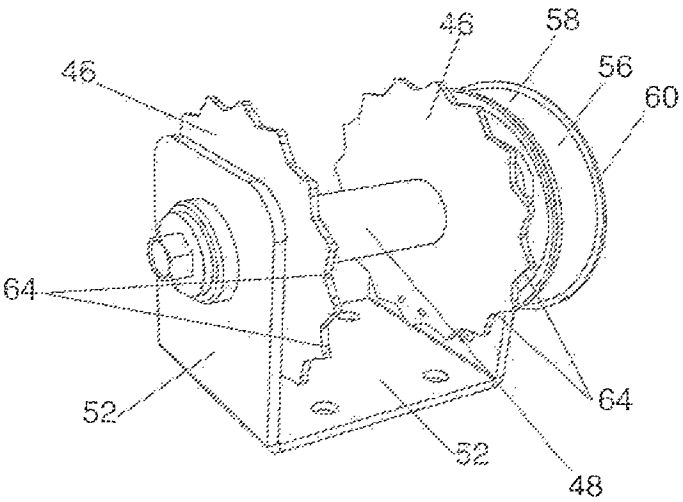
FIG. 9 is a perspective view of the present invention.
Figure 10:
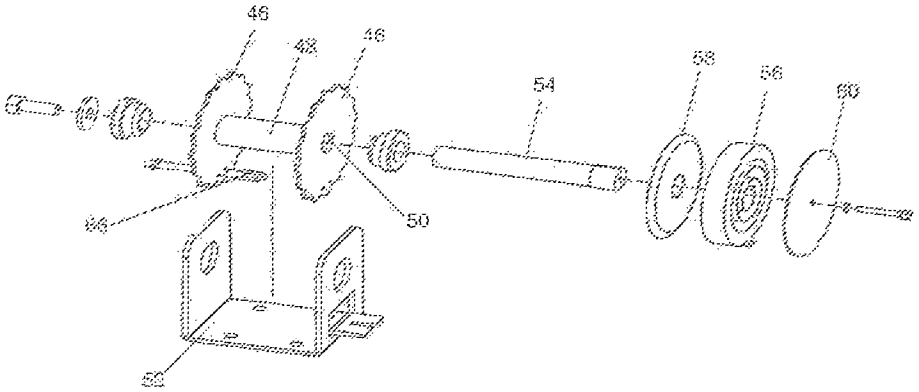
FIG. 10 is an exploded view of the spool of the present invention.
Figure 11:
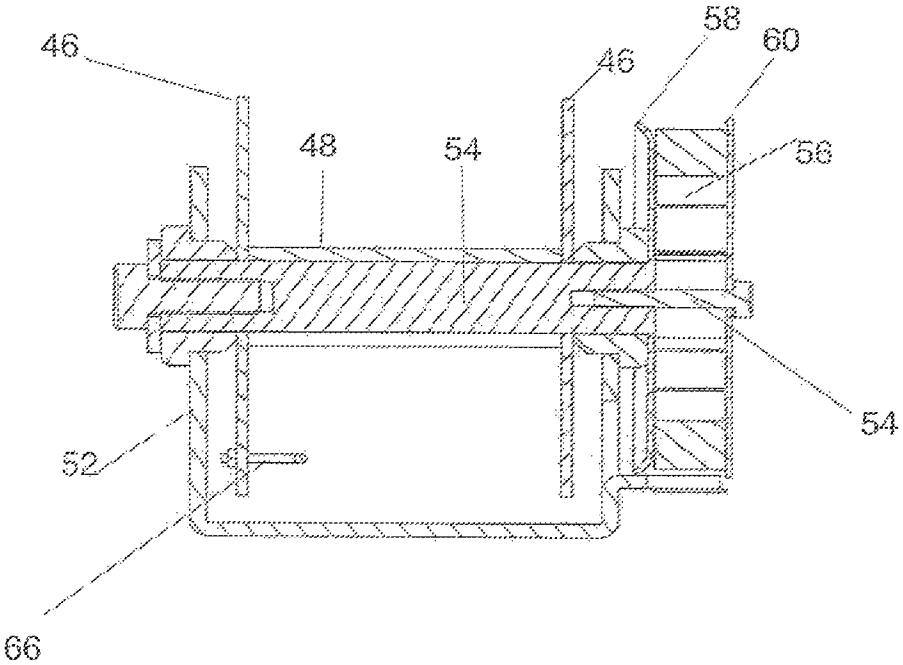
FIG. 11 is a sectional view of the spool and spring assembly of the present invention.

The spool 16 includes two side walls 46 connected by a shaft 48 as shown in FIGS. 8-10. The mooring cable 18 is wrapped around the shaft 48 of the spool 16 and can be wound mechanically or unwound manually from the spool 16. A carabiner 44 is attached to the mooring cable 1B on one end. The opposite end of the mooring cable 1B is attached to an attachment loop 66 on one of the side walls 46 of the spool 16. The outside surface of each of the side walls has an opening 50 for mounting the spool 16 in a c-bracket 52. The spool 16 rotates within the c-bracket 52. The c-bracket 52 also includes two openings. An arbor 54 is received through the two openings in the c-bracket 52 and the two openings 50 in the side walls 46 of the spool 16. Bearings preferably receive the arbor 54 on opposite sides of the c-bracket 52. The spool 16 is preferably spring loaded for automatic retraction of the mooring cable 18 when the locking mechanism is released. Arbor 54 is attached on one end through the center of a spring 56. A front spring plate 58 and a back spring plate 60 are positioned on either side of the spring 56. The arbor 54, front spring plate 58, and back spring plate 60 are secured by a bolt or similar fastening means. The c-bracket 52 is mounted to the bottom piece of the canister 12 by fasteners 26 as shown in FIG. 6. These fasteners preferably are nuts, bolts, and washers, but they may alternatively be any fasteners well-known to those skilled in art.

Figure 12:
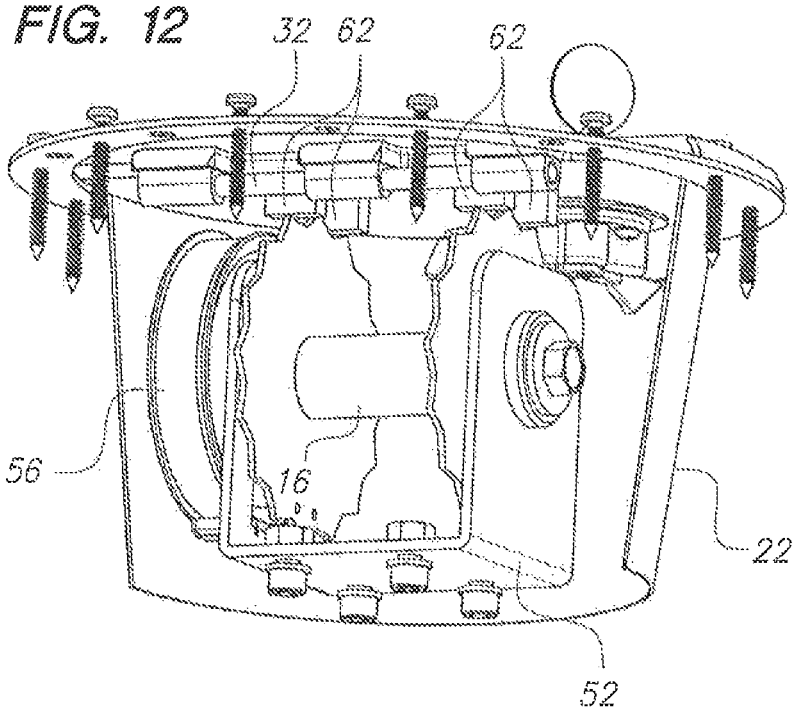
FIG. 12 is a front cut-away view of the spool and the stops of the present invention.
Figure 15:
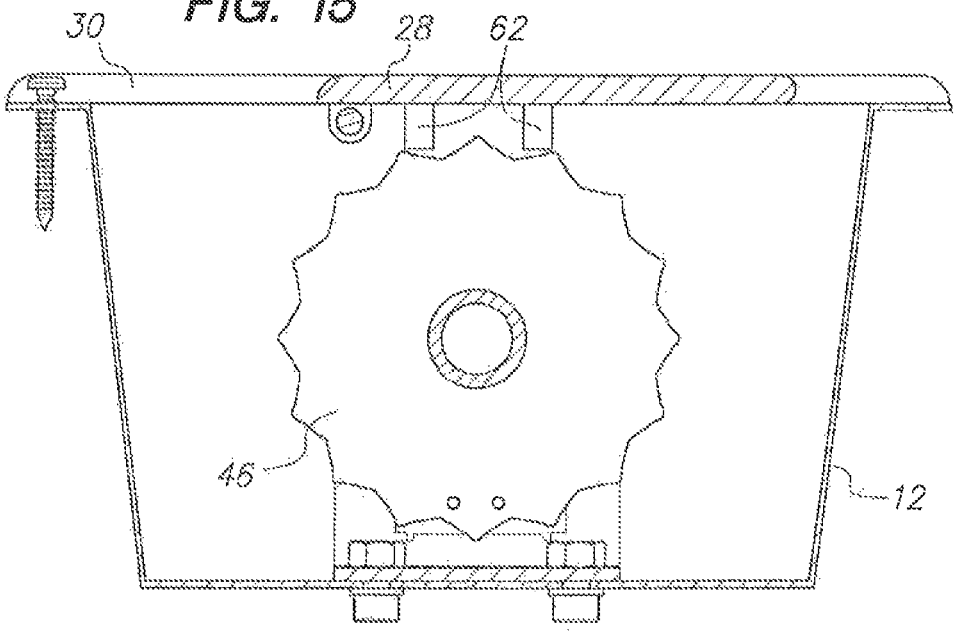
FIG. 15 is a side cut-away view of the spool and the lid of the present invention.
Figure 16:
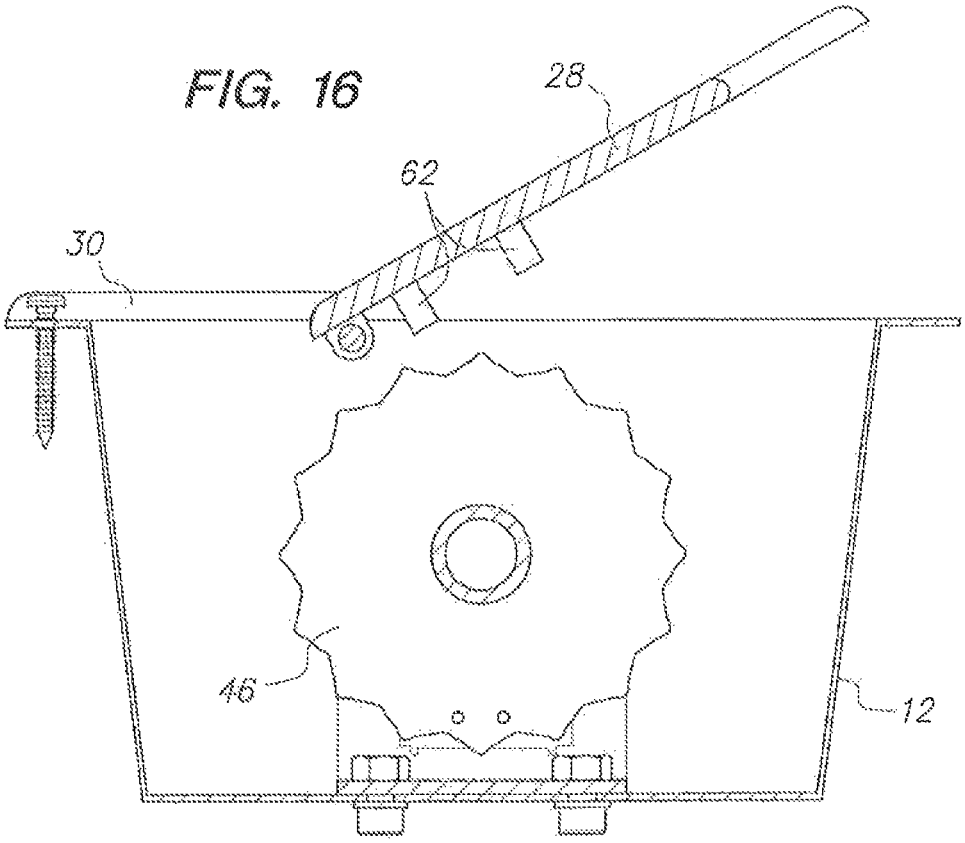
FIG. 16 is a side cut-away view of the spool and the lid of the present invention.

As shown in FIG. 12, the locking mechanism of the mooring device 10 utilizes the spool 16 and stops 62 that extend downwardly from the bottom surface of the lid 14. The perimeter of each of the side walls 46 of the spool 16 includes notches 64. There are preferably four stops 62: two stops aligned to engage the notches 64 on the first side wall 46 of the spool and two stops aligned to engage the notches 64 on the second side wall 46 of the spool. The spool is locked, and thus the length of mooring cable 10 is set, when the notches of the spool 16 and the stops 62 are engaged. As shown in FIG. 16, when the first piece 28 of the lid 14 is opened or raised, the stops 62 become disengaged with the notches 64 in the spool 16. The disengagement allows the length of the mooring cable 1B outside the canister 12 either to extend by a user pulling on the mooring cable 18 or to retract automatically as a result of the action of the spring 56. Once the mooring cable 18 is pulled or retracted to the appropriate length, the first piece 28 of the lid 14 can be closed. As shown in FIG. 15, the closing of the first piece 28 of the lid 14 causes the engagement of the stops 62 on the lid 14 and the closest notch 64 on the spool 16. Because the length of the mooring cable 18 can be controlled and the mooring cable 18 is attached to the boat via the carabiner 44, there is no excess mooring cable 18 to clutter either the boat or the dock. The carabiner 44 at the end of the mooring cable 18 can be clipped directly to the boat. As shown in FIG. 13, in an alternative embodiment, instead of being installed in the floor of a deck, pier, or slip, the mooring device 10 is attached to a post or elevated structure attached to the deck, pier, or slip via a bracket that is attached to the side wall 22 of the canister 12. While the side walls 46 of the spool extend perpendicular to the water surface in the first preferred embodiment, the side walls 46 of the spool extend parallel to the water surface in the second preferred embodiment.

Figure 17:
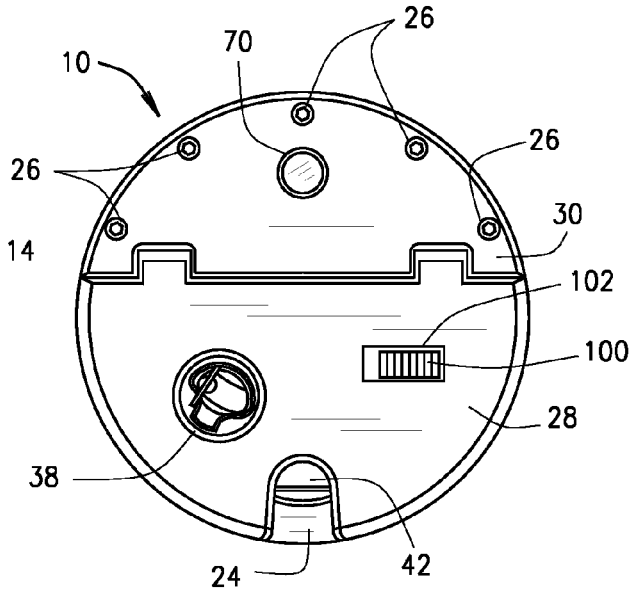
FIG. 17 is a top view of the preferred embodiment of the present invention; New
Figure 26:
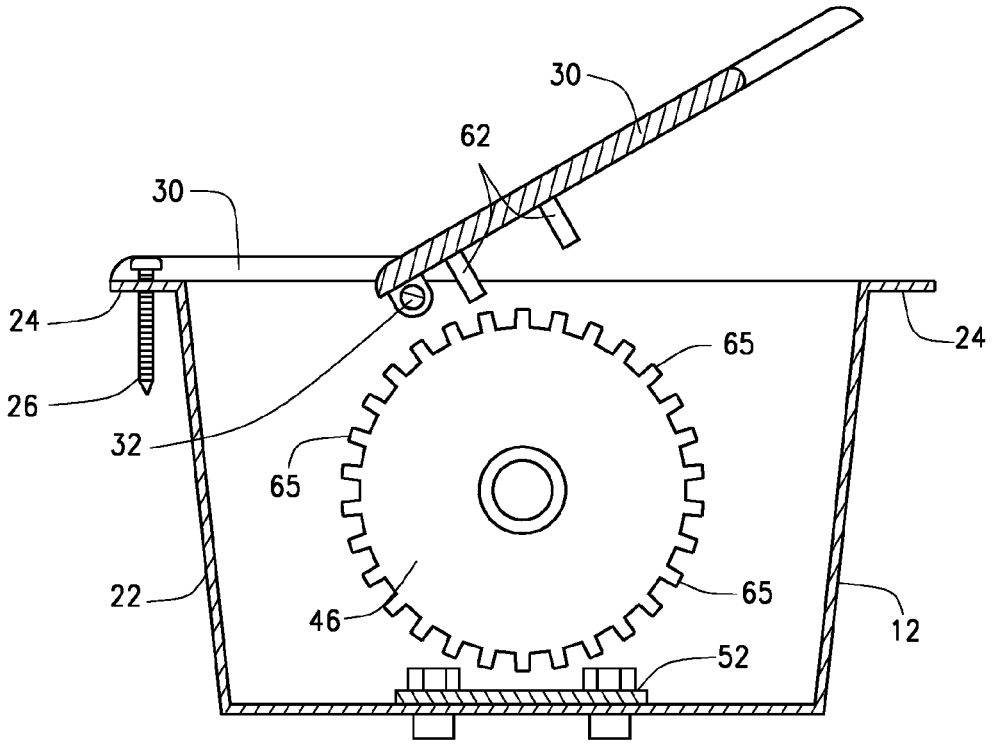
FIG. 26 is a sectional view of the preferred embodiment with the lid open.

FIG. 17 shows a top view of the invention 10 installed upon a dock 34 and the like. The lid 14 appears with its second portion as at 30 upwardly in this figure. The second portion 30 has a generally semicircular shape here in the top view and it secures by fasteners 26 to the canister 12, not shown, but below the lid 14. The second portion has a solar powered light 70 placed within it and that emits light upwardly and outwardly from the second portion and thus the invention. The light has at least one photovoltaic cell, at least one battery, at least one light emitting diode, wiring, and the like within a housing. The housing has a transparent surface above the photovoltaic cell and the light emitting diode. The light 70 provides illumination that allows a vessel owner to identify the location of the invention during tie up of the vessel at night and in bad weather. Then the second portion has a hinged connection, or hinge, as at 32, to the first portion 28 of the lid 14. The hinge generally spans across the diameter of the canister. Here the first portion remains closed upon the canister and generally coplanar with the second portion. This figure shows the closed position of the first position with coplanar first and second portions, and later, FIG. 26 shows the first position in an open position generally at an angle to the second portion and to the canister. The first portion 28 has the components operable by a user. The first portion has its generally semicircular shape inverted and opposite that of the second portion and the first portion has an opening 42 generally shown as an inverted U shape with a rounded bottom towards the center of the lid 14. The opening has a depth greater than its width as shown. The opening 42 exposes a portion of the flange 24 of the canister 12. To the left, or clockwise, from the opening, the first portion 28 has the lock assembly 38 as described above. To the right, or counter-clockwise, from the opening the first portion 28 has a generally rectangular slot 102 parallel to the hinged connection of the lid 14, that is, the longitudinal portion of the rectangular opening parallels the lid's hinge. This embodiment has a tidal adjustment switch, or thumbpad 100, shown within the slot 102 towards the right of the figure. The thumbpad 100 also may slide to the left of the figure. Towards the right, the thumbpad unlocks the spool 16 of this embodiment so it may turn freely. Towards the left, the thumbpad locks the spool 16 of this embodiment and prevents its rotation within the canister. The thumbpad has ridges and the like thereon to assist a user in gripping it.

Figure 18:
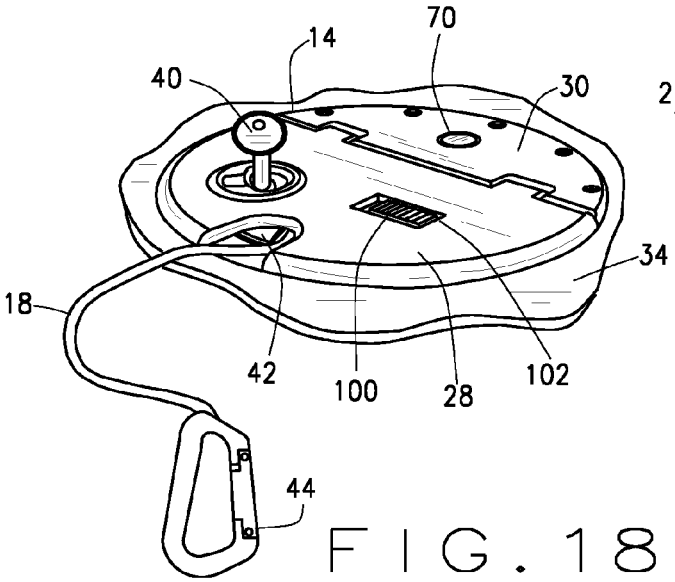
FIG. 18 is a top perspective view of the preferred embodiment.

Turning the invention, FIG. 18 shows a mooring cable 8 extending from within the invention through the opening 42 and terminating in a carabiner 44 as shown. Though this figure shows a carabiner, the Applicant foresees other grasping parts at the end of the cable, such as hooks, eyes, dog clips, screw anchors, knots, bowlines, and the like. Thought this description refers to mooring cable 8, the Applicant also foresees using rope, line, stay, and the like. The lid 14 extends upwardly from the dock 34 as shown. More particularly, the lid 14 has its second portion 30 rearward and rightward in this figure. The second portion remains fixed to the canister using the fasteners 26 as previously shown. The solar light 70 has its generally centered position in the second portion. The second portion provides a fixed surface upon with the first portion 28 of the lid pivoting upwardly from the second portion. The first portion has its lock assembly as before but with a key 40 shown engaging the lock. The key may cooperate with a cylinder having pins, a male star shaped fitting, a pentagonal fitting, or other custom feature of a nature that deters opening by common tools. Opposite the key, the first portion has the rectangular slot 102 with the tidal adjustment switch, also called thumbpad 100, placed within it and here shown to the right.

Figure 19:
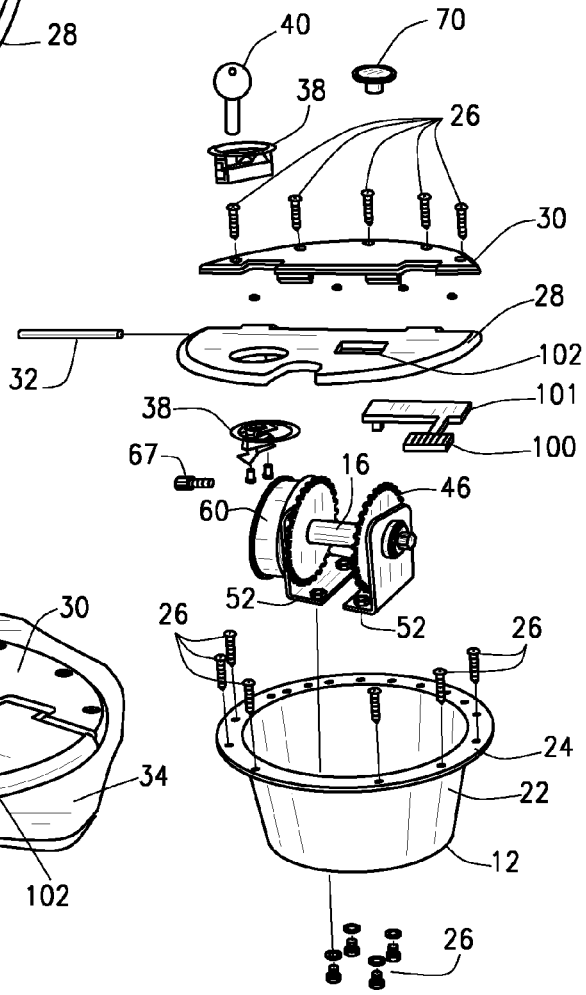
FIG. 19 is an exploded view of the preferred embodiment.

FIG. 19 then shows the preferred embodiment of the invention in an exploded view. The invention has its canister 12 that contains the other components of the invention when later assembled. The canister has a hollow form cylindrical in shape and a top surface and an opposite bottom. The top surface includes the flange 24 that extends around the canister. The flange receives at least four fasteners that secure the second portion to it. Opposite the flange, the canister has its bottom. The bottom has a plate that spans across the diameter of the canister but of lesser diameter than the flange. The bottom as plate bolts to the remainder of the canister. The bottom may also have its form integral with the remainder of the canister as from a punched metal blank. A plurality of fasteners 26, here shown as six, enters cooperating holes in the flange and secures the canister to a nearby dock surface. These six fasteners appear below the first portion 28 of the lid. Spanning from the flange downwardly, a sidewall 22 connects the bottom to the top to form the cylindrical shape of the canister. The sidewall extends around the perimeter of the canister and has a height less than the diameter of the canister. The first lid conceals the six fasteners while the second lid fastens to the flange and conceals those fastener thus the invention deters theft with its concealed fasteners to a dock.

A plurality of other fasteners 26, here shown as four, enters holes in the bottom and mechanically connects to the brackets 52. Each bracket has a generally L like shape with a flat bottom and an upright sidewall. The sidewalls include generally centered apertures that receive the spool 16. The spool extends between the sidewalls as shown and the spool has a longitudinal axis upon which it rotates. The spool's axis has a generally parallel orientation to a plane defined by the second portion of the lid, further, the axis is generally parallel to the axis of the hinged connection of the first portion to the second portion of the lid. The spool has two ends with a toothed sidewall 46 upon each end. The toothed sidewalls generally extend parallel to the sidewalls 52*a*. Outwardly from one sidewall and opposite on toothed sidewall, the embodiment has its spring 60 within its own housing protected from water, dust, and insects. Proximate the spring and securing through a sidewall of a bracket, a set screw 67 allows a user to prevent spool rotation when the first portion of the lid is opened. Above the spool and toothed sidewalls of this figure, the invention has a portion of the lock assembly 38 positioned beneath the first portion 28 of the lid. Opposite the lock assembly, the embodiment in this figure has the thumbpad 100 extending from a spine 101 with four stops 62 beneath the spine as later shown and described in FIGS. 27-29. The first portion then has its semicircular shape with the diameter inward to the figure and the curved edge outward to the figure. The first portion has two tabs, spaced apart, that receive the rod 32 through holes in the tabs parallel to the diameter. The rod allows the first portion to move in hinge action relative to the second portion 30 of the lid. The first portion has the opening 42 centered along the curved edges and a cooperating opening to the left for the lock assembly and the rectangular slot 102 to the right of the opening 42 for the cable. And slightly above the first portion in this figure, the second portion 30 of the lid has its semicircular planar shape, similar to that of the first portion where both portions each are planar. The second portion has its diameter forward in this figure and the curved portion into the background. The diameter mates with that of the first portion and has two indents that cooperate with the tabs of the first portion. Along the curved portion, a plurality of fasteners 26, here shown as five, enters cooperating holes for threaded engagement into the flange 24 below. The lock assembly 38 then receives a cooperating key 40.

Figure 20:
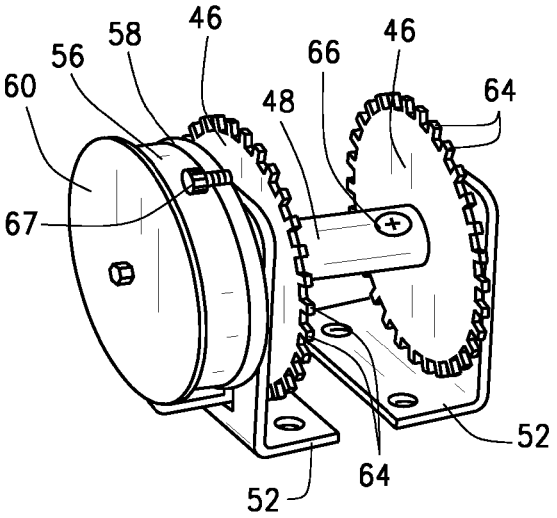
FIG. 20 is a perspective view of the spool of the preferred embodiment.

Looking more closely at the spool 16, FIG. 20 shows the spool in a perspective view with its spring forward. As briefly mentioned above, two brackets 52 of an L shape each with an upright sidewalls that supports the spool upwardly from the bottom of the bracket so it may turn. The spool further includes a shaft 48 generally cylindrical and hollow as later shown in FIG. 22. The shaft has a threaded aperture that receives an attachment pin 66. The attachment pin anchors the cable to the spool so that it winds properly. Later when the cable ages and becomes no longer serviceable, a user can unthread the pin 66 and release the cable from the spool for its replacement. Similar to the spool, the shaft has a longitudinal axis about which it rotates. The shaft has two spaced apart ends that receive the toothed sidewalls 46. One toothed sidewall is outwardly from the attachment pin and within the nearby sidewall of the bracket and the other toothed sidewall has a position opposite the attachment pin but inwardly from the other sidewall. Each toothed sidewall has a plurality of notches that engage the thumbpad and related hardware, as later described.

Outwardly from the toothed sidewall opposite the attachment pin and outwardly from the other bracket sidewall, that is, to the right of the figure, the invention has its spring assembly that retracts the cable 8. The spring assembly has a back spring plate 60, generally round and in rotational communication to the arbor. In an alternate embodiment, the spring plate has a hollow cylindrical form open on one end, such as a cap, with a depth suitable for covering the remainder of the spring assembly. In an alternate embodiment, the spring plate remains encased within a casing and the casing attaches to the sidewall of a bracket. As shown, the back spring plate then abuts the spring 56 itself. The spring is of a coil variety and it tightens, or extends, upon pulling of the cable 8 outwardly from the canister 12. The spring tightens in an increasing manner making it more difficult to extract greater lengths of cable from the invention. Typically, the spring has a bias against rotation of the spool when unwinding the cable. Inwardly from the spring 56, the spring assembly has its front spring plate 58 here shown on edge that cabins, or contains the spring, preventing its contact with the sidewall 52*a* nearby. The back spring plate, spring, front spring plate, and their various embodiments cooperate to prevent water, dust, insects, debris, and the like from entering the spring and fouling it. The front spring plate also has a set screw 67 that extends towards the toothed sidewall 46. Most of the time, the set screw is retracted towards the front spring plate so that it does not interfere with the front spring plate. On rare occasions, a user advances the set screw away from the front spring plate and towards the toothed sidewall. The set screw then engages between to teeth of the sidewall. Having the set screw prevent rotation of the sidewall and spool assists the user in installing a new cable to the spool or later in removing a cable for cleaning, winter storage, or replacement.

Figure 21:
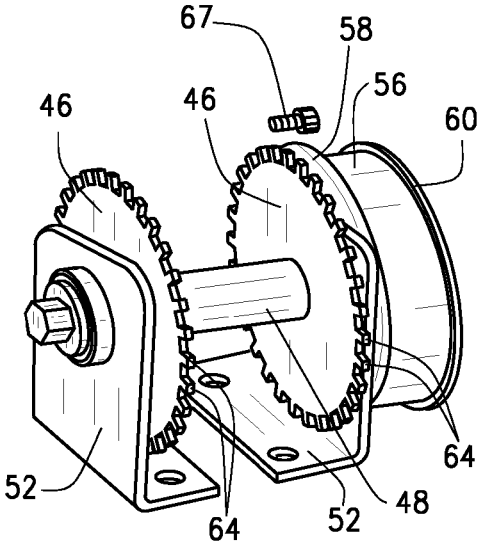
FIG. 21 is another perspective view of the spool of the preferred embodiment.

Turning the bracket to the left, FIG. 21 shows the spool 16 with the spring assembly into the background. The bracket 52 has its sidewalls supporting the shaft 48 between them. The shaft has its two ends and one end extends through an aperture in the sidewall to the left of this figure. The shaft then has a mechanical connection fixing it to the sidewall while permitting rotation. In one embodiment, the shaft has journaled connections to the brackets. In another embodiment, the spool has a journaled connection to each bracket. In a further embodiment, the journaled connection includes ball bearings such as stainless steel.

Figure 22:
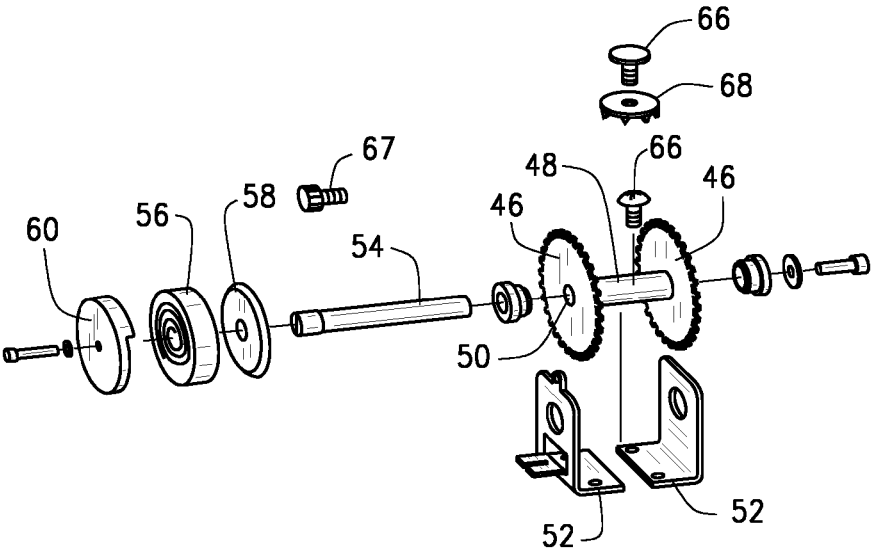
FIG. 22 is an exploded view of the spool of the preferred embodiment.

The spool 16 and spring assembly appear in FIG. 22 as an exploded view. The bracket 52 has its U shape as before with two spaced apart sidewalls. Each sidewall has an aperture through it that admits the shaft as previously described and more particularly admits an arbor 54. The sidewall to the right of the figure has a tab of two teeth perpendicular to the sidewall and parallel to the bottom of the bracket. This tab engages the coil spring 56. From the left, mechanical parts, such as bolt, washer, and bearing engage an opening upon the spool, that is, at one end of the shaft inwardly of the bearing and the sidewall, one toothed sidewall 46 joins to an end of the shaft 48. This end has the attachment pin 66 nearby that threadily engages an aperture in the shaft. The attachment pin fits within a toothed washer 68. In combination, the toothed washer 68 and the attachment pin 66 secure a fixed end of the mooring cable 8 to the shaft and prevents slippage of the mooring cable upon the spool. The toothed washer physically embeds into the mooring cable. The shaft continues to its other end and receives the second toothed sidewall 46. The two toothed sidewalls have a fixed connection to the shaft, thus the sidewalls and shaft rotate as a unit. Outwardly from the second toothed shat and the other sidewall 52*a* with its tab for the coil spring, a bearing admits an arbor 54 of a solid, elongated cylinder. The arbor extends through the shaft to its mechanical components on the left and to the right the arbor has length to receive the front spring plate 58, the spring 56, and the back spring plate 60. The arbor imparts the contractive torque, converted into rotation, from the spring 56 axially into the shaft. The shaft may turn many rotations as long as the spring contracts. Under tidal and other action, the end of the cable 8 moves with a vessel, not shown, as the shaft turns with the arbor.

Figure 23:
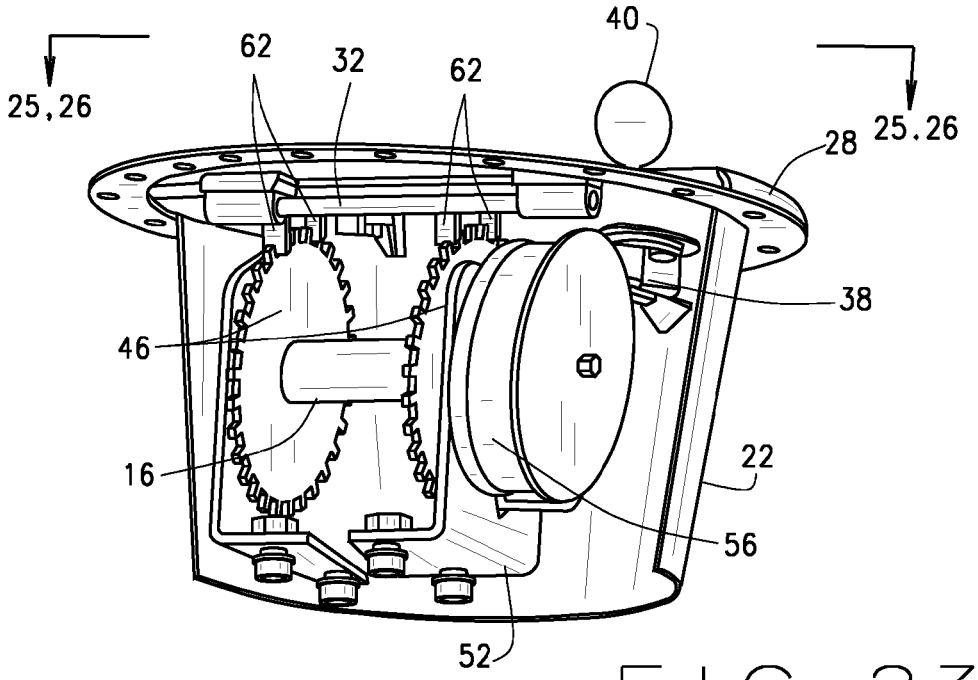
FIG. 23 is a sectional view of the spool and spring assembly of the preferred embodiment.

FIG. 23 shows a partial sectional view upwardly from the bottom of the canister 12 as when installed in a dock, not shown. This view removes a portion of the sidewall 22 of the canister showing the spool 16 installed upon the brackets 52 and the brackets installed to the bottom of the canister. The spring 56 appears to the right of the figure within a cover. The spool 16, as previously described appears, within the sidewall 22 of the canister with the spring 56 and the two toothed sidewalls engage two pairs of stops 62. The stops have mutual spacing within a pair and the pairs of stops have a spacing apart that matches the spacing of the two toothed sidewalls 46. The stops have a position generally opposite the bottom of the bracket and outwardly of the rod 32 upon which the first portion of the lid pivots. The stops have a generally rectangular shape here shown engaging into the teeth of the toothed sidewalls. Each stop fits precisely between two adjacent teeth as later shown in FIG. 25. For clarity in this figure, the second portion of the lid is not shown. Each toothed sidewall engages two stops for prevention of rotation of the sidewalls and spool. The stops move in coordination with the thumbpad for the desired setting of the user.

Figure 24:
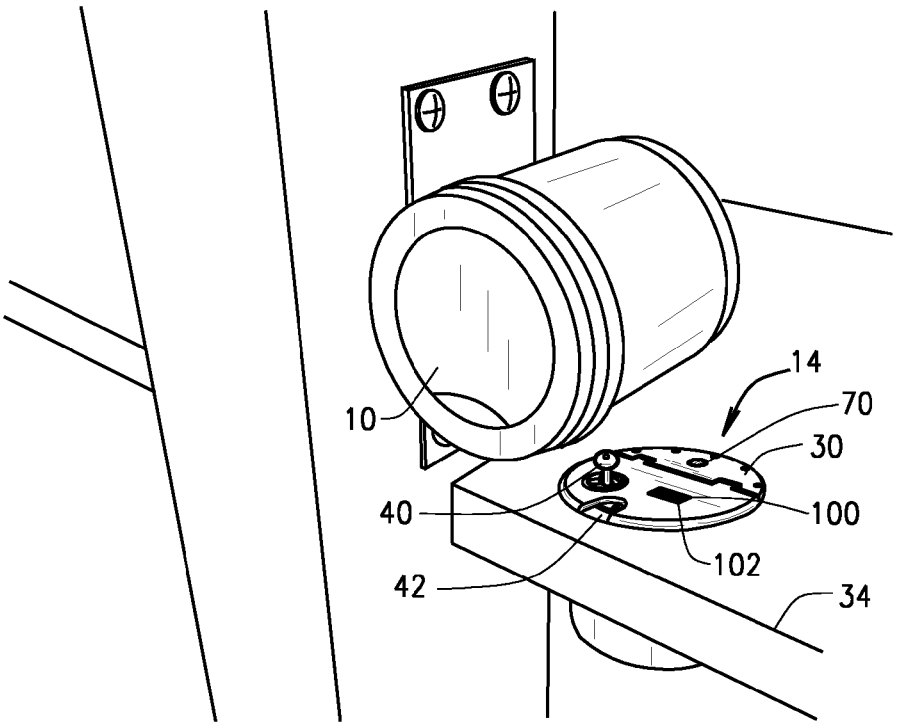
FIG. 24 is a perspective view of two installations for the preferred embodiment.

FIG. 24 shows two installations of the preferred embodiment of the invention. To the left, the invention 10 mounts to a vertical post and has its mooring line or cable extensible outwardly from the plane of the figure. To the right of this figure, the preferred embodiment installs upon the flat deck of a dock 34 through an appropriately sized aperture that admits the canister 12. The canister then hangs within and sometimes beneath the dock surface as shown. The flange 24 abuts the dock surface and the lid 14 remains slightly elevated from the dock surface as shown. The embodiment has the second portion of the lid inwardly to the dock and the first portion of the lid outwardly to the dock, that is, towards a nearby vessel in a slip, not shown. The first portion has the key 40 extending upwardly from the lock assembly towards the left of the opening. To the right of the opening, the first portion has the thumbpad 100 within the rectangular slot 102. The thumbpad moves left to right generally parallel to the hinge between the two portions of the lid. Opposite the key 40 and the thumbpad 100, the second portion 30 has its solar light 70.

Figure 25:
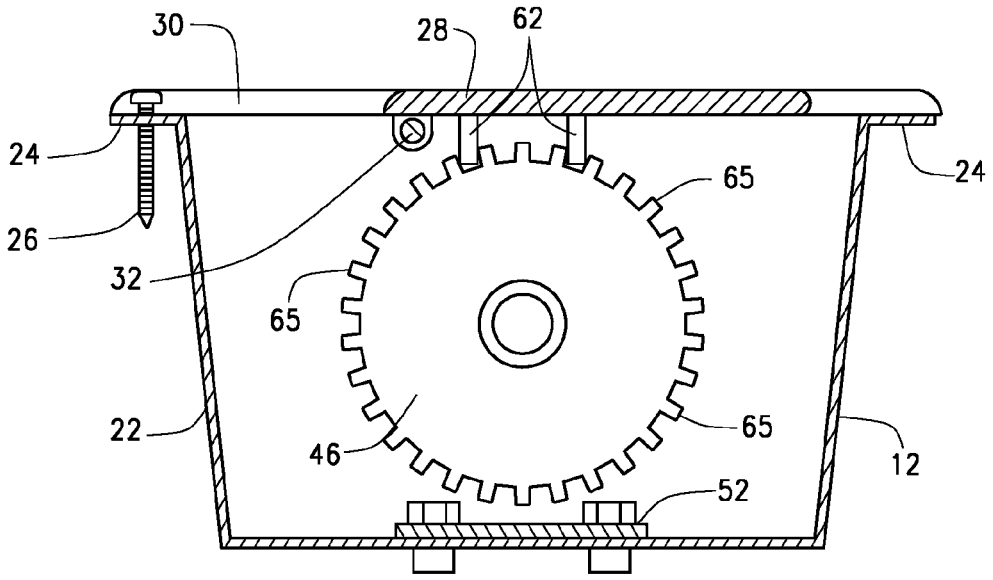
FIG. 25 is a sectional view of the preferred embodiment with the lid closed.

Turning to FIG. 25, the preferred embodiment appears in a sectional view with the lid 14 closed upon the sidewall 22 of the canister 12. The canister has its downward orientation as it would when installed into a dock. The lid has its second portion 30 shown to the left and the first portion 28 shown towards the right. Both the second portion and the first portion rest upon the flange 24. The rod 32 provides the pivotal connection between the second portion and the first portion. The rod has a position slightly below the plane of the lid. Inwardly from the rod and away from the second portion, the first portion has two of four stops 62 shown. The four stops have a coaxial arrangement so two more stops are behind the stops shown in this figure. The two pairs of stops have a spacing apart to match that of the spacing apart for the toothed sidewalls 46 of the spool as previously shown. The preferred embodiment has a toothed sidewall 46 shown in this figure.

The toothed sidewall has a perimeter and a plurality of teeth 65 in a crenellated arrangement around that perimeter as shown. Each tooth is generally square in shape. Two teeth fit snugly within the two stops and each stop fits within two teeth as shown. The two teeth within the two stops prevent rotation of the sidewall when the thumbpad slides the stops to the left, that is, into the foreground of this figure. Locking the spool, as when the stops engage the teeth, assists an owner to secure his vessel and prevent the vessel from moving more than is necessary. When the thumbpad slides the stops to the right, that is, into the background, the stops do not engage the teeth 65 of the sidewall 46 so that the spool turns freely, subject to the action of the spring assembly. A freely turning spool assists an owner in paying out the cable 8 during initial tie up of a vessel and later in removing the cable 8 from the spool for cleaning or replacement. In the preferred embodiment, each toothed sidewall has thirty teeth regularly spaced about the perimeter of the sidewall. Each tooth has an approximate four millimeter width and an approximate five millimeter height. Each tooth has a spacing of approximately six millimeters from the next tooth. Each toothed sidewall has an approximate diameter of one hundred millimeters.

Turning to FIG. 26, the preferred embodiment has the first portion 28 of the lid hingedly connected to the second portion 30 at the rod 32. Upon releasing the lock, a user may lift the first portion upwardly, that is, rotate counterclockwise upon the rod. In doing so, the stops 62 disengage from the teeth 65 and the spool turns freely under the action of the spring. A user can then access the cable and spool for usage, winding, unwinding, cleaning, and inspection. More particularly, a user lifts the first portion so that the spring automatically retracts the cable.

Figure 27:
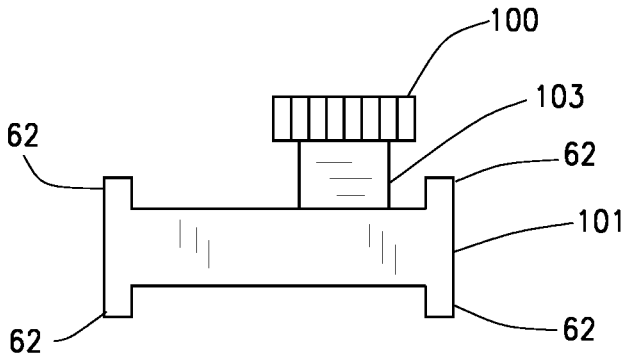
FIG. 27 is a top view of the tidal adjustment switch.

The tidal adjustment switch, or thumbpad, appears by itself in FIG. 27 as a top view. The thumbpad 100 has its rectangular form with ribs or knurling as previously described. The thumbpad joins to a stem 103 of lesser width and length than the thumbpad itself. The stem provides mechanical connection and an offset of the thumbpad to the spine 101. The offset allows for convenient placement of the thumbpad for users as previously shown and engagement of the stops to the toothed sidewalls. The spine has a generally elongated rectangular form of greater length than the thumbpad itself, typically a length to span between the two toothed sidewalls described above. The spine has four corners and extending from each corner is a stop 62 and the stops have an arrangement of two spaced apart pairs for four stops in total. The stops extend into the plane of this figure and oppositely from the thumbpad.

Figure 28:
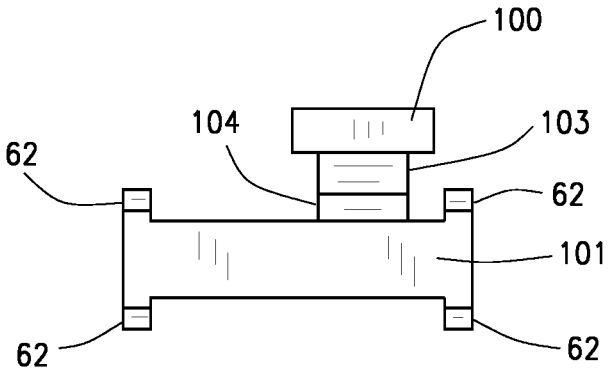
FIG. 28 is a bottom view of the tidal adjustment switch.

FIG. 28 shows a bottom view of the thumbpad 100. The thumbpad has its elongated rectangular shape as before but with a smooth surface. The smooth surface provides for smooth travel in the rectangular slot 102 as previously described. The stem extends from the thumbpad to the spine 101. The stem has a step as at 104 because the thumbpad and the spine occupy different vertical planes where the thumbpad is slightly higher than the spine 101 when installed in the first portion of the lid. The spine has its rectangular shape with two parallel and spaced apart longitudinal sides and two parallel and spaced apart lateral ends. The lateral ends have lesser length than the longitudinal sides and are perpendicular to the longitudinal sides. A corner occurs at the intersection of a longitudinal side and a lateral end. The spine has the four stops 62, one at each corner. The stops extend out of the plane of this figure for their height as previously described. Each pair of stops upon a lateral end has spacing between the stops that admits two teeth 65 snugly as previously described. The length of the spine is approximately that of the spacing between the two toothed sidewalls so that each pair of stops upon a lateral end engages a toothed sidewall.

Figure 29:
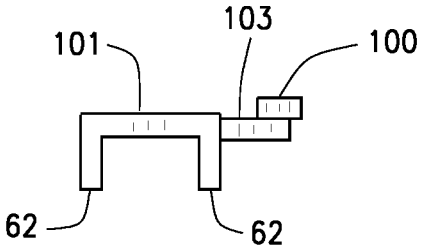
FIG. 29 is a side view of the tidal adjustment switch.

And, FIG. 29 shows an end view of the thumbpad 100 and spine 101. The spine 101 has two stops 62, mutually spaced apart upon a lateral end. The stops descend from the plane of the spine for at least the thickness of the spine. Behind one stop, here shown on the right, and outwardly from a longitudinal side of the spine, the stem 103 extends perpendicular to the length of the spine. The stem then joins to the thumbpad 100. The thumbpad has its plane above the spine. The thumbpad's position allows a user to move it left and right at the surface of the first portion while the spine remains concealed beneath the first portion of the lid. A user may adjust the thumbpad so the spool may turn freely or remain fixed and the user need not open the lid to do so. The user may move the thumbpad with the spine to one side and disengages the stops from the toothed sidewalls for free rotation of the spool. The user may move the thumpad with the spine to the other side and engages the stops into the toothed sidewalls preventing rotation of the spool, locking it.

From the aforementioned description, a mooring device has been described. The mooring device is uniquely capable of allowing a line or cable to extend and retract under tidal or weather action without a user opening the device. The mooring device also contains a line or cable in a compact space with a top surface flush to an adjacent dock or boat deck. Further, the mooring device may also have drainage holes therein. The mooring decorative cover device and its various components may be manufactured from many materials, including but not limited to, vinyl, polymers, such as nylon, polypropylene, polyvinyl chloride, high density polyethylene, polypropylene, ferrous and non-ferrous metal foils, their alloys, and composites.

Various aspects of the illustrative embodiments have been described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations have been set forth in order to provide a thorough understanding of the illustrative embodiments. However, it will be apparent to one skilled in the art that the present invention may be practiced without the specific details. In other instances, well known features are omitted or simplified in order not to obscure the illustrative embodiments.

Various operations have been described as multiple discrete operations, in a manner that is most helpful in understanding the present invention, however, the order of description should not be construed as to imply that these operations are necessarily order dependent. In particular, these operations need not be performed in the order of presentation.

Moreover, in the specification and the following claims, the terms "first," "second," "third" and the like—when they appear—are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to allow the reader to ascertain the nature of the technical disclosure. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

I claim:

1. A mooring device, comprising:

a canister;

a lid upon said canister;

two brackets mounted to said canister opposite said lid;

a spool operatively positioned within said brackets, said spool having an axis generally parallel to said lid;

said spool having two mutually parallel and spaced apart toothed sidewalls, a shaft centered between said toothed sidewalls, and a spring assembly operatively connected to said shaft and position outwardly of one of said brackets wherein said spring assembly biases against rotation of said spool;

each of said toothed sidewalls having a perimeter and a plurality of teeth regularly spaced upon the perimeter;

said lid having a first portion and a second portion, said first portion connecting to said second portion upon a hinge, said hinge spanning said canister, wherein said second portion is fixed to said canister and said first portion has an open position and a closed position coplanar with said second portion;

a thumbpad within said first portion, said thumbpad movable parallel to said hinge, said thumbpad joining to a spine, said spine operating beneath said first portion;

said spine having two pairs of mutually spaced apart stops, said stops extending opposite from said thumbpad;

said stops engaging said toothed sidewalls upon said first portion attaining said closed position and said thumbpad positioning said spine towards said toothed sidewalls wherein said spool does not rotate;

wherein said thumbpad positions said spine away from said toothed sidewalls disengaging said stops and wherein said spool rotates freely; and, a mooring cable wrapped around said spool and extending from said canister during usage.

2. The mooring device of claim 1 further comprising:

said spine having an elongated rectangular shape, two mutually parallel and spaced apart longitudinal sides, two mutually parallel and spaced apart lateral ends, said lateral ends being perpendicular to said longitudinal sides, four corners where each of said longitudinal sides intersects with a lateral end, a stem extending from one of said longitudinal sides proximate one of said lateral ends, said stem having a thickness and a step in that thickness, said stem joining to said thumbpad;

wherein said thumbpad is mutually parallel and spaced apart from said spine.

3. The mooring device of claim 2 further comprising:

each of said stops locating upon each of said corners of said spine.

4. The mooring device of claim 3 further comprising:

each pair of said stops engaging between two of said teeth upon each of said sidewalls wherein said first portion is closed, wherein said thumbpad is positioned inwardly upon said lid, and wherein said spine is positioned inwardly beneath said first portion.

5. The mooring device of claim 1 further comprising:

said spring assembly having one of a back spring plate and a cover, a coil spring, a front spring plate, a set screw extending inwardly from said front spring plate, wherein said one of a back spring plate and a cover and said front spring plate contain said spring within them;

said front spring plate connecting to one of said brackets and said one of a back spring plate and a cover connecting to said front spring plate; and, said set screw extending between two of said teeth of one of said toothed sidewalls upon rotation by a user.

6. The mooring device of claim 5 further comprising:

an arbor, generally elongated and cylindrical, said arbor having a length greater than said shaft, said arbor extending outwardly from said shaft towards said spring assembly; and, said coil spring operatively connecting to said arbor and to said front spring plate wherein said coil spring elongates upon said arbor rotating as said spool unreels said mooring cable and wherein said coil spring contracts upon an ease of tension in said mooring cable.

7. The mooring device of claim 2 further comprising:

said first portion having a rectangular slot receiving said thumbpad; and, said spine moving outwardly from said rectangular slot.

8. The mooring device of claim 1 further comprising:

said canister having a flange beneath said lid;

a lock assembly within said first portion of said lid, said lock assembly engaging said flange to secure said device closed;

said thumbpad locating opposite said lock assembly within said first portion;

a solar powered light within said second portion; and, a set screw extending from one of said brackets proximate said spring assembly towards one of said toothed sidewalls wherein said set screw inserts between two of said teeth when a user desires to prevent rotation of said spool during changing of said mooring cable.

9. The mooring device of claim 1 further comprising:

each of said toothed sidewalls having thirty teeth;

each of said teeth having a square shape;

each pair of said stops engaging between two of said teeth upon each of said sidewalls wherein said first portion is closed, wherein said thumbpad is positioned inwardly upon said lid, and wherein said spine is positioned inwardly beneath said first portion;

wherein two of said teeth abut interiorly a pair of said stops flush; and, wherein said teeth and said toothed sidewalls remain spaced away from said mooring cable.

10. A device for securing watercraft comprising:

a shaft;

two mutually parallel and spaced apart toothed sidewalls centered upon said shaft, each of said toothed sidewalls being perpendicular to the axis of rotation of said shaft, each of said toothed sidewalls having a perimeter and a plurality of teeth regularly spaced upon the perimeter;

said toothed sidewalls and said shaft forming a spool;

said spool being journaled between two spaced apart brackets;

a spring assembly operatively connected to said shaft and positioned outwardly of one of said brackets wherein said spring assembly biases against rotation of said spool;

said brackets mounting to a canister, said canister being hollow and having a bottom;

a lid upon said canister;

said lid having a first portion and a second portion, said first portion hingedly connecting to said second portion across said canister, wherein said second portion is fixed to said canister opposite said bottom and said first portion has an open position and a closed position coplanar with said second portion, and said spool having an axis generally parallel to said lid;

a thumbpad within said first portion, said thumbpad movable parallel to said hinged connection, said thumbpad joining to a spine, said spine operating beneath said first portion;

said spine having two pairs of mutually spaced apart stops, said stops extending opposite from said thumbpad;

said stops engaging said toothed sidewalls upon said first portion attaining said closed position and said thumbpad positioning said spine towards said toothed sidewalls wherein said spool does not rotate;

wherein said thumbpad positions said spine away from said toothed sidewalls disengaging said stops and wherein said spool rotates freely; and, a mooring cable wrapped solely around said shaft and extending from said canister for usage.

11. The device for securing watercraft of claim 10 further comprising:

said spring assembly having a cover, a coil spring contained within said cover, a front spring plate opposite said cover, a set screw extending inwardly from said front spring plate;

said front spring plate connecting to one of said brackets and said cover connecting to said front spring plate;

said set screw extending between two of said teeth of one of said toothed sidewalls upon rotation by a user;

an arbor, generally elongated and cylindrical, said arbor positioned within said shaft, said arbor having a length greater than said shaft thus extending outwardly from said shaft towards said spring assembly; and, said coil spring operatively connecting to said arbor and to said front spring plate wherein said coil spring elongates upon said arbor rotating as said spool unreels said mooring cable and wherein said coil spring contracts upon an ease of tension in said mooring cable.

12. The device for securing watercraft of claim 10 further comprising:

said spine having an elongated rectangular shape, two mutually parallel and spaced apart longitudinal sides, two mutually parallel and spaced apart lateral ends, said lateral ends being perpendicular to said longitudinal sides, four corners where each of said longitudinal sides intersects with a lateral end, a stem extending from one of said longitudinal sides proximate one of said lateral ends, said stem having a thickness and a step in that thickness, said stem joining to said thumbpad;

wherein said thumbpad is mutually parallel and spaced apart from said spine.

13. The mooring device of claim 12 further comprising:

each of said stops locating upon each of said corners of said spine.

14. The mooring device of claim 13 further comprising:

each pair of said stops engaging between two of said teeth upon each of said sidewalls wherein said first portion is closed, wherein said thumbpad is positioned inwardly upon said lid, and wherein said spine is positioned inwardly beneath said first portion.

15. The mooring device of claim 12 further comprising:

said first portion having a rectangular slot receiving said thumbpad; and, said spine moving outwardly from said rectangular slot.

16. The mooring device of claim 10 wherein said stops and said teeth of said toothed sidewalls avoid contact with said mooring cable.

17. The mooring device of claim 13 further comprising:

a lock assembly within said first portion of said lid;

said canister having a flange opposite said bottom and beneath said lid;

said lock assembly engaging said flange to secure said device closed; and, said thumbpad locating opposite said lock assembly within said first portion.

18. The mooring device of claim 10 wherein each of said toothed sidewalls has thirty teeth, each of said teeth has a square shape, each pair of said stops engages between two of said teeth upon each of said toothed sidewalls wherein said first portion is closed, wherein said thumbpad is positioned inwardly upon said lid and said spine is positioned inwardly beneath said first portion;

wherein two of said teeth abut interiorly a pair of said stops flushly;

a solar powered light within said second portion; and, a set screw extending from one of said brackets proximate said spring assembly towards one of said toothed sidewalls wherein said set screw inserts between two of said teeth when a user desires to prevent rotation of said spool during changing of said mooring cable.

19. A mooring device comprising:

a canister;

a lid upon said canister;

two brackets mounted to said canister opposite said lid;

a spool operatively positioned within said brackets, said spool having an axis generally parallel to said lid;

said spool having two mutually parallel and spaced apart toothed sidewalls, a shaft centered between said toothed sidewalls, and a spring assembly operatively connected to said shaft and position outwardly of one of said brackets wherein said spring assembly biases against rotation of said spool;

each of said toothed sidewalls having a perimeter and a plurality of teeth regularly spaced upon the perimeter;

said lid having a first portion and a second portion, said first portion connecting to said second portion upon a hinge, said hinge spanning said canister, wherein said second portion is fixed to said canister and said first portion has an open position and a closed position coplanar with said second portion;

a thumbpad within said first portion, said thumbpad movable parallel to said hinge, said thumbpad joining to a spine, said spine operating beneath said first portion;

said spine having two pairs of mutually spaced apart stops, said stops extending opposite from said thumbpad and engaging said toothed sidewalls upon said first portion attaining said closed position and said thumbpad positioning said spine towards said toothed sidewalls wherein said spool does not rotate;

wherein said thumbpad positions said spine away from said toothed sidewalls disengaging said stops and said spool rotates freely; and, a mooring cable wrapped around said spool, later extending from said canister during usage, and wherein said stops and said teeth of said toothed sidewalls remain spaced away from said mooring cable;

said spine having an elongated rectangular shape, two mutually parallel and spaced apart longitudinal sides, two mutually parallel and spaced apart lateral ends, said lateral ends being perpendicular to said longitudinal sides, four corners where each of said longitudinal sides intersects with a lateral end, a stem extending from one of said longitudinal sides proximate one of said lateral ends, said stem having a thickness and a step in that thickness, said stem joining to said thumbpad, wherein said thumbpad is mutually parallel and spaced apart from said spine;

each of said stops locating upon each of said corners of said spine, each pair of said stops engaging between two of said teeth upon each of said sidewalls wherein said first portion is closed, wherein said thumbpad is positioned inwardly upon said lid, and wherein said spine is positioned inwardly beneath said first portion;

said first portion having a rectangular slot receiving said thumbpad and said spine moving outwardly from said rectangular slot;

said second portion having a solar powered light;

said canister having a flange beneath said lid, a lock assembly within said first portion of said lid and engaging said flange to secure said device closed, and, said thumbpad locating opposite said lock assembly within said first portion.

20. The mooring device of claim 19 wherein each of said toothed sidewalls has thirty teeth, each of said teeth has a square shape, each pair of said stops engages between two of said teeth upon each of said toothed sidewalls wherein said first portion is closed, wherein said thumbpad is positioned inwardly upon said lid and said spine is positioned inwardly beneath said first portion;

wherein two of said teeth abut interiorly a pair of said stops flushly; and, a set screw extending from one of said brackets proximate said spring assembly towards one of said toothed sidewalls wherein said set screw inserts between two of said teeth when a user desires to prevent rotation of said spool during changing of said mooring cable.

* * * * *